United States Patent [19]

Hayashi et al.

[11] Patent Number: 4,697,915

[45] Date of Patent: Oct. 6, 1987

[54] IMAGE FORMING APPARATUS WITH DETECTING AND CONTROLLING MEANS

[75] Inventors: Kimiyoshi Hayashi; Akio Ohno; Kazuhiko Hirooka; Yasushi Murayama, all of Tokyo, Japan

[73] Assignee: Canon Kabushiki Kaisha, Tokyo, Japan

[21] Appl. No.: 813,066

[22] Filed: Dec. 24, 1985

[30] Foreign Application Priority Data

Dec. 26, 1984 [JP] Japan ..... 59-273280

[51] Int. Cl.[4] ..... G03G 15/06

[52] U.S. Cl. ..... 355/14 D; 355/3 DD; 355/4

[58] Field of Search ..... 335/3 DD, 4, 14 D, 14 R

[56] References Cited

U.S. PATENT DOCUMENTS 4,620,783 11/1986 Tanaka et al. ..... 355/14 D

FOREIGN PATENT DOCUMENTS 60-232569 11/1985 Japan ..... 355/4

60-260968 12/1985 Japan ..... 355/4

*Primary Examiner*—Arthur T. Grimley

*Assistant Examiner*—Jane K. Lau

*Attorney, Agent, or Firm*—Fitzpatrick, Cella, Harper & Scinto

[57] ABSTRACT

In an image forming apparatus wherein a plurality of developing devices are carried on a rotating body and the rotating body is rotated to thereby move desired one of the developing devices to a predetermined developing position and develop a latent image formed on a latent image bearing member in accordance with image information, an image forming operation is permitted only when all of the developing devices are carried on the rotating body.

7 Claims, 8 Drawing Figures

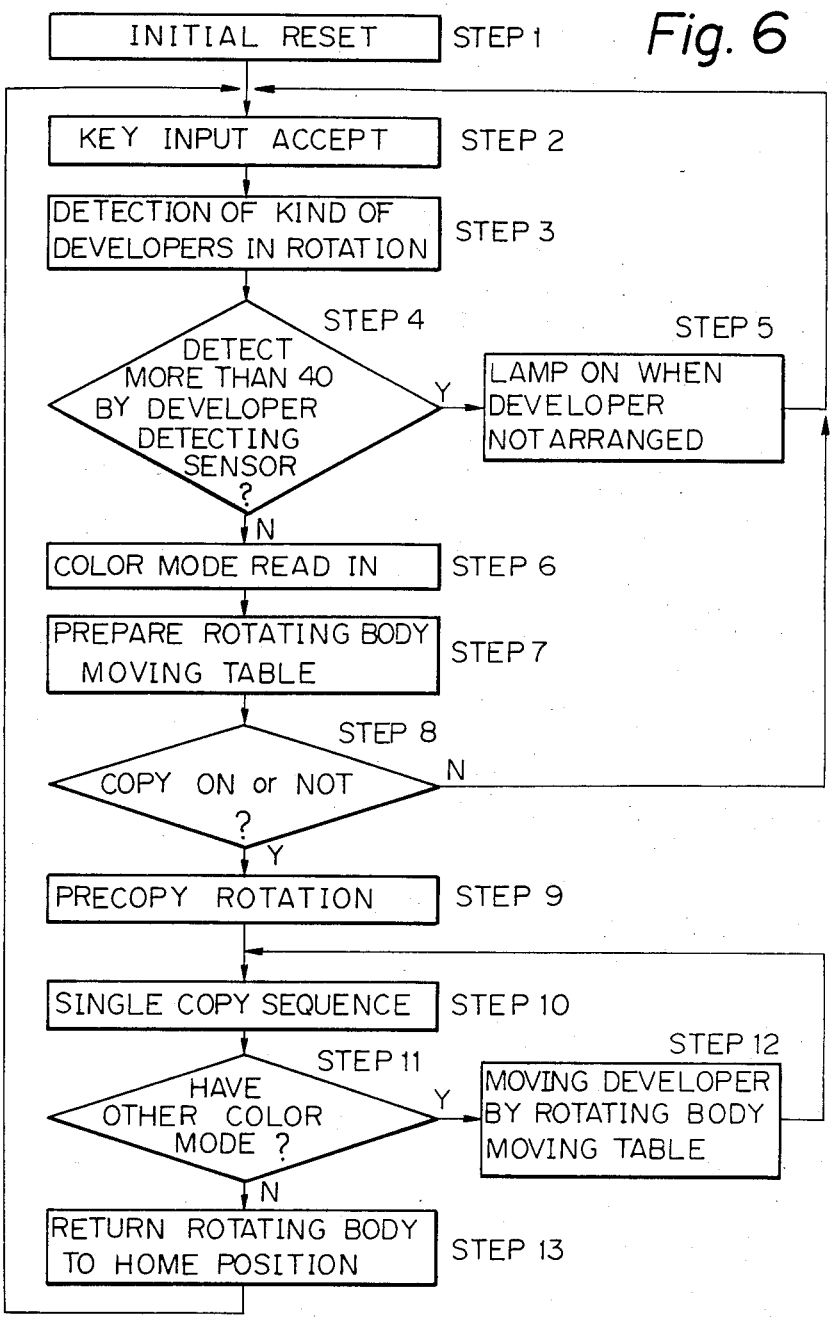
Fig. 6
INITIAL RESET
STEP 1
KEY INPUT ACCEPT
STEP 2
DETECTION OF KIND OF DEVELOPERS IN ROTATION
STEP 3
STEP 4
DETECT MORE THAN 40 BY DEVELOPER DETECTING SENSOR ?
Y
STEP 5
LAMP ON WHEN DEVELOPER NOT ARRANGED
N
COLOR MODE READ IN
STEP 6
PREPARE ROTATING BODY MOVING TABLE
STEP 7
STEP 8
COPY ON or NOT ?
N
Y
PRECOPY ROTATION
STEP 9
SINGLE COPY SEQUENCE
STEP 10
STEP 11
HAVE OTHER COLOR MODE ?
Y
STEP 12
MOVING DEVELOPER BY ROTATING BODY MOVING TABLE
N
RETURN ROTATING BODY TO HOME POSITION
STEP 13

Fig. 7

55a 55b 55

| | |
|---|---|
| 0 1 | 0 1 |
| 0 2 | 0 2 |
| 0 3 | 0 3 |
| 0 4 | 0 4 |
| 0 5 | 0 0 |

Fig. 8

56

| | |
|---|---|
| 0 1 | 0 1 |
| 0 2 | 0 3 |
| 0 3 | 0 5 |
| 0 4 | 0 7 |
| 0 5 | 0 0 |

IMAGE FORMING APPARATUS WITH DETECTING AND CONTROLLING MEANS

BACKGROUND OF THE INVENTION

1. Field of the Invention

This invention relates to an image forming apparatus such as an electrophotographic apparatus for forming multicolor images (color images of two or more colors) or full color images and an image forming apparatus provided with a color recording and developing device constituting the output portion of a computer, a facsimile apparatus or the like.

2. Description of the Prior Art

As such an image forming apparatus, there is known, for example, a color electrophotographic copying apparatus for forming full color images. As the developing device in such copying apparatus, a plurality of developing devices containing developers of different colors therein are disposed relative to a latent image bearing member such as a photosensitive drum. On the other hand, as the arrangement and construction of the developing devices, there have heretofore been proposed an arrangement in which the plurality of developing devices are successively disposed along the peripheral surface of the latent image bearing member and an arrangement in which the plurality of developing devices are supported by a rotating body and by this rotating body being rotatively driven, only the developing device corresponding to the developer of a desired color is opposed to the latent image bearing member. In the case of the former, the plurality of developing devices are arranged along the peripheral surface of the latent image bearing member and therefore, the circumferential length of the latent image bearing member is necessarily long, which in turn leads to a disadvantage that the latent image bearing member becomes bulky. In contrast, in the case of the latter, one developing device is always opposed to the latent image bearing member and therefore, the circumferential length of the latent image bearing member can be minimized and accordingly, the latent image bearing member can be made compact. Thus, to make the image forming apparatus compact, it is effective to adopt the latter developing device.

However, in the rotational type developing device having a rotating body rotated while carrying such a plurality of developing devices thereon, a partial rotation moment acts on the rotating member unless all of the developing devices are carried at the developing device carrying positions on the rotating body. In such a case, a drive motor for rotatively driving the rotating body must have a great output sufficient to overcome the partial rotation moment and accordingly, the drive motor becomes great in capacity and expensive. Also, where a servo mechanism or the like is employed as control means for controlling the drive motor, there has been a problem that the control circuit of the drive motor becomes complicated due to the partial load of the drive motor.

Further, where the plurality of developing devices are carried on the rotating body, if each developing device is not mounted at a predetermined carrying position, there has been an undesirable possibility that the latent image on the latent image bearing member is developed by developer of a color different from a desired color.

SUMMARY OF THE INVENTION

It is an object of the present invention to provide an image forming apparatus in which a developing device may be smoothly rotated without any biased rotation moment acting on the developing device.

It is another object of the present invention to provide an image forming apparatus in which color information to be developed always corresponds to a developing device containing developer of that color therein and is not developed in a wrong color.

Other objects and features of the present invention will become apparent from the following detailed description thereof taken in conjunction with the accompanying drawings.

BRIEF DESCRIPTION OF THE DRAWINGS

FIG. 6 is a flow chart showing the operational control of the developing device.

FIG. 7 illustrates color mode table registers.

FIG. 8 illustrates color mode registers.

DESCRIPTION OF THE PREFERRED EMBODIMENTS

An embodiment of the present invention will hereinafter be described with reference to the drawings.

Figure 1:
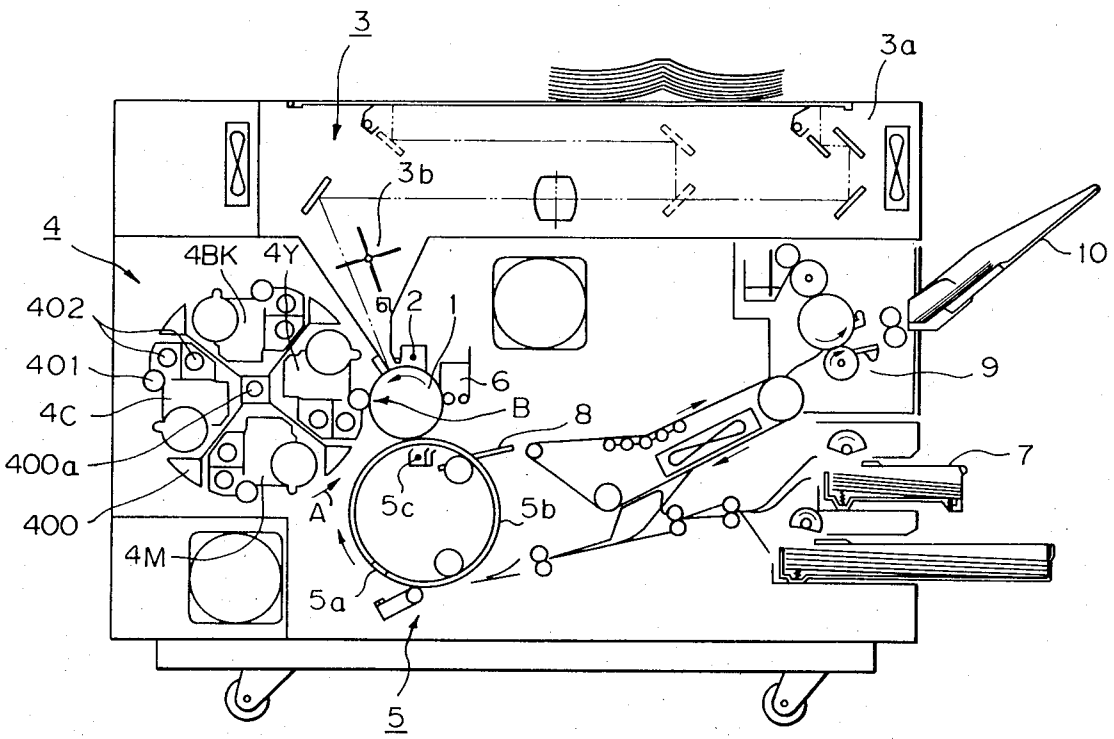
FIG. 1 a schematic cross-sectional view of a color copying apparatus according to an embodiment of the present invention

FIG. 1 shows an embodiment of the color copying apparatus to which the present invention is applied.

In FIG. 1, a photosensitive drum 1 which is a latent image bearing member is rotatable in the direction of arrow. Around the drum 1, there are disposed a charger 2, an exposure optical system 3, a developing device 4, a transfer system 5 and a cleaning device 6. The optical system 3 has an original scanning unit 3*a* and a color resolving filter unit 3*b*. The developing device 4 integrally has a yellow developing device 4Y using yellow toner, a magenta developing device 4M using magenta toner, a cyan developing device 4C using cyan toner, and a black developing device 4BK using black toner. The developing devices 4Y, 4M, 4C and 4BK, as disclosed in applicant's Japanese Patent Publication No. 20579/1980, are removably supported on a rotating body 400 so that the developing openings of the developing devices are positioned substantially on the same circumference. The rotating body 400 carries the developing devices 4Y, 4M, 4C and 4BK at predetermined positions thereon, is rotated about a shaft 400*a* in the direction of arrow 4, moves any desired developing device to a developing position B and sets it at the developing position. In FIG. 1, the developing device 4Y is shown as being set at the developing position B. Each developing device, as shown in the developing device 4C, has a developing roller 401, a developer stirring screw 402, etc. Even when the rotating body 400 is rotated, scattering of toner may be prevented by the action of the magnetic field by a magnet roller provided in the developing roller 401. The transfer system 5 has a transfer drum 5b having a gripper 5a, and a transfer charger 5c therewithin.

Formation of a color image will now be described briefly. The photosensitive drum 1 is uniformly charged by the charger 2, whereafter it is exposed to a color-resolved optical image of an original by the exposure optical system 3 through the color resolving filter 3b. Thereby, an electrostatic latent image corresponding to a color component of the original is formed on the photosensitive drum 1. This electrostatic latent image is developed by corresponding one of the developing devices 4Y, 4M, 4C and 4BK. On the other hand, a transfer medium is supplied from a cassette to the transfer drum 5b through well-known conveying means and is pre-supported by the gripper 5a, while being wound round the transfer drum 5b. The developed image is transferred to the transfer medium on the transfer drum by the transfer charger 5C.

In this manner, the steps of forming a color-resolved image of the original on the photosensitive drum, developing it by a predetermined toner and transferring the developed image to the transfer medium are successively repeated a plurality of times (for example, in the case of a full color image, development is effected four times by the use of four kinds of toners, i.e., yellow, magenta, cyan and black toners), whereby a color image corresponding to the original can be formed on the transfer medium.

After the transferring step has been completed, the transfer medium is liberated from the gripper 5a, is separated from the transfer drum 5b by separating means 8 and is conveyed to fixing means 9 through a conveyor belt. Fixation of the image is effected by the fixing means 9, whereafter the transfer medium is discharged onto a tray 10. Thus, a color image is formed.

Figure 2:
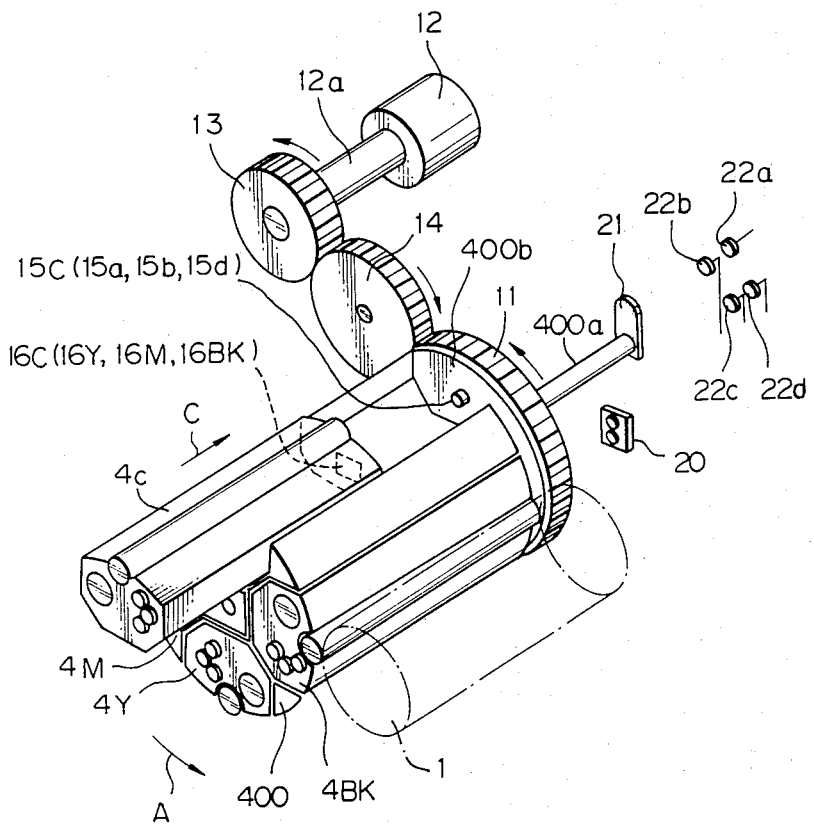
FIG. 2 is a perspective view showing the essential portions of a rotational type developing device.

The developing device according to the present invention will now be described. FIG. 2 shows the essential portions of the developing device 4. The rotating body 400 has a disc-like rearward plate 400b at the rear end thereof, and a gear 11 is integrally provided on the rearward plate 400b. Designated by 12 is a servo-motor for driving the rotating body. A gear 13 secured to one end of the output shaft 12a of the servo-motor 12 is connected to the gear 11 of said rotating body through a gear 14. In the rotating body 400 shown, the black developing device 4BK is in the developing position B opposed to the photosensitive drum 1, and in addition, the yellow developing device 4Y, the magenta developing device 4M (unseen in FIG. and the cyan developing device 4C are carried on the rotating body 400. In the example shown, the cyan developing device 4C is being mounted onto the rotating body 400 from the direction of arrow C.

A sensor 15c provided on the rearward plate 400b of the rotating body 400 is a photosensor for detecting the presence of the developing devices and the kinds of the developing devices. Although not shown, like the sensor 15c, a sensor 15d, a sensor 15a and a sensor 15b are provided on the rearword plate 400b of the rotating body 400 at respective locations whereat the black developing device 4BK, the yellow developing device 4Y and the magenta developing device 4M are mounted. These sensors have a function similar to that of the sensor 15c.

On the other hand, reflecting plates 16Y, 16M, 16C and 16BK are provided on the rear end surfaces of the developing devices 4Y, 4M, 4C and 4BK, respectively, so as to be opposed to the respective sensors when the developing devices are mounted on the rotating body. In FIG. 2, only the reflecting plate 16C provided on the cyan developing device 4C is shown. The reflecting plates 16Y, 16M, 16C and 16BK have different inherent reflectances, and the photosensors 15a, 15b, 15c and 15d are adapted to put out signals of different voltage levels in conformity with the quantities of reflected light from the respective reflecting plates. Thus, the photosensors 15a, 15b, 15c and 15d provided on the rotating body 400 and the reflecting plates 16Y, 16M, 16C and 16BK provided on the developing devices 4Y, 4M, 4C and 4BK, respectively, together constitute means for detecting the developing devices.

Figure 3:
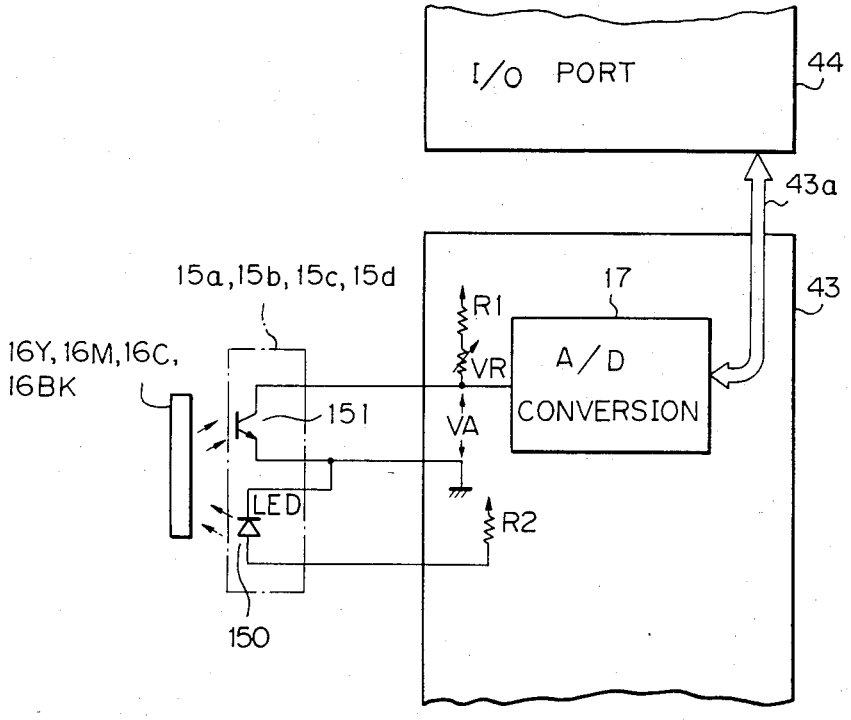
FIG. 3 illustrates developing device detecting means.

This detecting means will hereinafter be described in detail with reference to FIG. 3. The reflection type photosensors 15a –15d each contain a light-emitting diode 150 and a light-receiving transistor 151 therein. For example, the output light of the light-emitting diodes 150 is reflected by the reflecting plate 16Y, 16M, 16C and 16BK and enters the light-receiving transistor 151. An analog output voltage VA corresponding to the quantity of incident light is digitalized by an A/D converter 17 provided in an input interface 43, and the digital signal is input to an I/O port 44 through a bus 43a.

On the other hand, the reflectances of the reflecting plates 16Y, 16M, 16C and 16BK differ from one another in conformity with the kinds of the developing devices, as described above. However, even the reflecting plate of the lowest reflectance is designed such that the difference in the reflectance thereof from a case where no developing device is mounted on the rotating body can be discriminated and therefore, of course, the level of said analog output voltage VA differs depending on the kinds of the developing devices and also differs between a case where the developing devices are mounted on the rotating body 400 and a case where the developing devices are not mounted on the rotating body 400.

Accordingly, if this analog output voltage VA is suitably adjusted through a variable resistor VR, the digital output signal of the A/D converter 17 can be set as shown in Table 1 below correspondingly to the kinds of the developing devices and to whether the developing devices are mounted on the rotating body 400, that is, the presence or absence of the developing devices, and thus, the kinds of the developing devices and the presence or absence of the developing devices can be detected reliably. In the present embodiment, an 8-bit A/D converter is used and according to this converter, it is possible to discriminate between 255 kinds of colors. The A/D converter may be replaced by a comparator or the like.

TABLE 1

| A/D conversion value | Kind of developing device |
|---|---|
| 00 - 0F | Yellow developing device |
| 10 - 1F | Magenta developing device |
| 20 - 2F | Cyan developing device |
| 30 - 3F | Black developing device |
| 40 - 4F | No developing device |

Description will now be made of means for detecting the stopped position of the rotating body 400. In FIG. 2, a reflecting plate 21 is secured to the center shaft 400of the rotating body 400 and is rotatable with the rotation of the rotating body 400. On the other hand, on the image forming apparatus body side, photosensors 22a, 22b, 22c and 22d are fixedly provided around the center shaft 400*a* of the rotating body 400. The position of the reflecting plate 21 may be detected by these photosensors 22*a*–22*d* to thereby enable the current position of the rotating body 400 to be known. In FIG. 2, reference numeral 20 designates the sensor of means for detecting the quantity of remaining tone (not shown) provided in the developing device. This sensor is provided outside the developing device 4.

Figure 4:
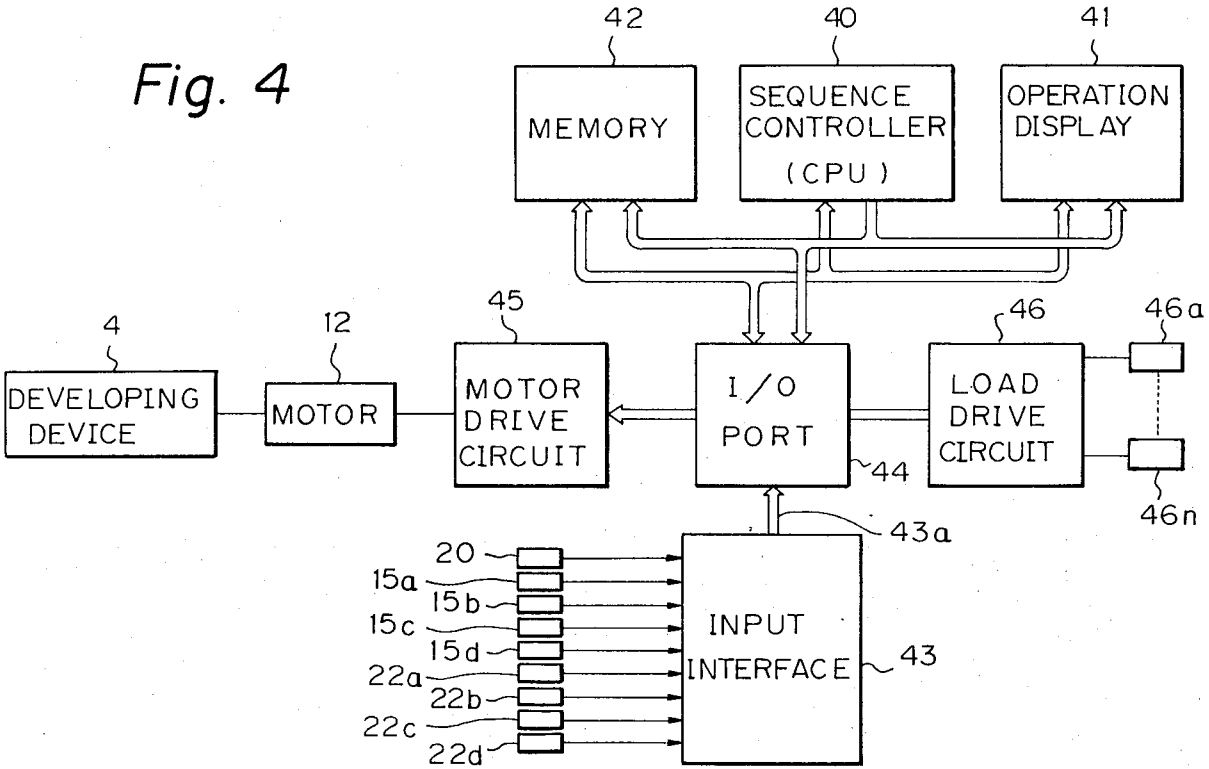
FIG. 4 is a block diagram of the control circuit of the image forming apparatus illustrating the operation of the developing device.

FIG. 4 is a block diagram showing the control circuit of the developing device according to this embodiment. In FIG. 4, reference numeral 40 designates a sequence controller (CPU) for generalizing the control of the entire image forming apparatus, reference numeral 41 denotes an operation and display unit (the details of which will later be described) provided with the operation and display key of the image forming apparatus, and reference numeral 42 designates a memory provided with an ROM into which an image formation program has been written in advance and an RAM for writing data thereinto. On the other hand, various signals for controlling the operation of the developing device 4, i.e., the signals from the sensor 20 for detecting the quantity of remaining toner, the developing device detecting sensors 15*a* –15*d* and the sensors 22*a*–22*d* for detecting the stopped position of the rotating body, are input to an input interface 43, and then are input to the memory 42 by the CPU 40 through an I/O port 44.

The instruction from the CPU 40 is supplied to a motor drive circuit 45 to control the driving motor 12 of the developing device 4. Thereby, the rotation of the rotating body 400 is controlled to move a desired developing device to the predetermined developing position.

Also, a load drive circuit 46 for driving various loads 46*a*–46*n* provided in the apparatus body to effect color copying is connected to the I/O port 44.

Figure 5:
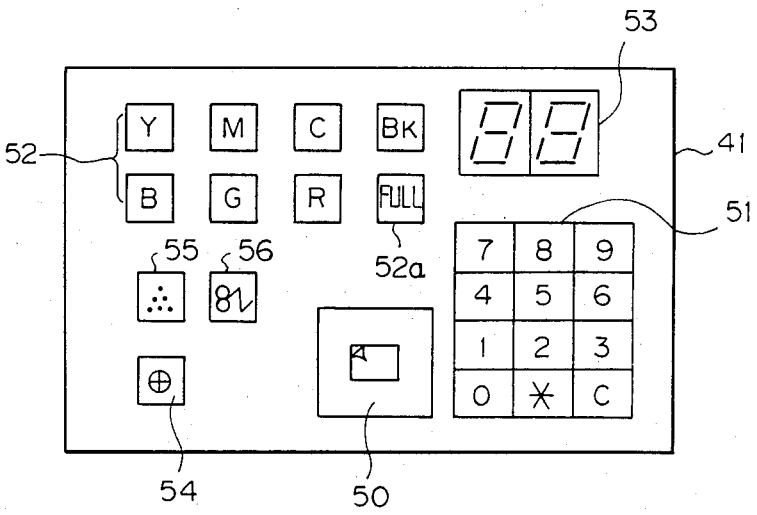
FIG. 5 is a schematic view of an operating portion and a display portion.

FIG. 5 shows the panel construction of the aforedescribed operation and display unit 41 of the image forming apparatus body. The panel is provided with input key operation portions such as a copy key 50, ten-keys 51 and color mode selecting keys 52, and display portions such as 7-segment numerical display 53, developing device unmounting display 54, toner supply display 55 and paper feed check display 56.

The operation control of the developing device will now be described by reference to the flow chart of FIG. 6.

First, the CPU 40 is started to clear the memory 42 and initialize the I/O port 44 (step 1).

Next, the CPU 40 accepts the copy key input and the color mode selecting key input of the operation and display unit 41, and for example, when copying is to be effected in the full color mode, the signal from the full color key 52*a* (see FIG. 5) of the color mode selecting keys 52 is input and therefore, this signal is stored in the memory 42 (step 2). Subsequently, the information from the developing device detecting sensors 15*a*–15*d* provided on the rotating body 400 is read as the A/D conversion values shown in Table 1 above (step 3).

If, at this time, the information from the developing device detecting sensors 15*a*–15*d* includes the A/D conversion value of 40 or more shown in Table 1, it is judged that no developing device is mounted (step 4), whereby the lamp of the developing device unmounting display 54 of the operation and display unit 41 is turned on and the program returns to the key input accept flow of step 2 (step 5).

Therefore, the copy key input is not accepted in the copy sequence and the rotating body driving motor 12 is not started. Thus, the rotating body 400 is not rotated and partial load rotation of the rotating body driving motor 12 is completely prevented. To release the above-described state, a predetermined developing device may be mounted at a location on the rotating body 400 whereat no developing device is mounted.

On the other hand, if all developing devices are mounted on the rotating body 400, the program proceeds to step 6, at which the color mode input through one of the color mode selecting keys 52 is made to correspond to the copying order thereof and is loaded as a color mode table into a register. For example, when the full color mode is input by the full color key 52*a*, the copying order data is loaded into the most significant register 55*a* of color mode table registers 55 shown in FIG. 7, and correspondingly to this copying order data, the full color mode in the form of a code number shown in Table 2 below is loaded into the least significant register 55*b*.

TABLE 2

| Color symbol | Code |
|---|---|
| Y (Yellow) | 01 |
| M (Magenta) | 02 |
| C (Cyan) | 03 |
| BK (Black) | 04 |
| Stop | 00 |

Here, the loading of the color mode table into the above-described color mode table registers 55 can be directly effected by the ten-keys 51. That is, when the "*" key is depressed, "01" is turned on and off in the 7-segment numerical display 53 and therefore, "0", "1" and "*" are key-input in accordance therewith. Next, "02" is turned on and off, and in a similar manner, "0", "2" and "*" are input "03" and "04"are likewise input and, after the last key-inputting of "0","4" and "*","*" is again input, whereby the mode designation is terminated, and at that time, correspondingly to "05" of the most significant bit 55*a* of the color mode table registers 55, "00" is written into the least significant bit 55*b*. What has been described above is the case of the four-color or full color mode, but again in the case of one-color, two-color or three-color copying, the "*" key is continuously input twice, whereby the least significant bit "00" of the order corresponding to the most significant bit of the color mode table registers 55 is written in.

Subsequently, when the reading of the color modes into the color mode table registers 55 is terminated and the copying order for each color mode is determined, the moved position of the rotating body 400 is designated.

This is accomplished by loading the movement table data of the rotating body into color mode registers 56 shown in FIG. 8 (step 7).

The movement table data of the rotating body will now be described. The developing device discrimination (color discrimination) information put out from the photosensors 15*a*, 15*b*, 15*c* and 15*d* constituting the detecting means for detecting the kinds of the developing devices and the presence or absence of the developing devices is converted into the aforedescribed digital information (A/D conversion value) as shown in Table 1, and the most significant bit of the digital information determined for each color plus "1" corresponds to the code of the color mode. Even when each developing device is mounted at any carrying position in the rotating body 400, inherent discrimination signals are put out from the developing device detecting photosensors 15*a*–15*d* in conformity with the differences between the reflectances of the reflecting plates determined for the developing devices and therefore, a developing device of which color is mounted at which carrying position in the rotating body is clear. So, the details of movement of the rotating body 400 are encoded as shown in Table 3 below and stored in the color mode registers 56 correspondingly to the color mode copying order.

TABLE 3

| Details of movement of rotating body | Movement code |
|---|---|
| Moved to home position | 00 |
| Sensor 15a, moved to developing position | 01 |
| Sensor 15b, moved to developing position | 03 |
| Sensor 15c, moved to developing position | 05 |
| Sensor 15d, moved to developing position | 07 |

Subsequently, the copy flag written into the memory 42 is discriminated and, if it is not input, the program returns to the key input accept (step 8), and if it is input, pre-copy rotation is effected, and the content "01" of the least significant register corresponding to the most significant "01" register of the color mode registers 56 of FIG. 8 which indicates the copying order is put out as position designating data to the motor drive circuit 45 of the I/O port 44, and the rotating body 400 is rotated to move a predetermined developing device (in the present example, the yellow developing device 4Y mounted at the location whereat the sensor 15*a* is provided) to the developing position (step 9). Thus, the single color copy sequence by the color of the toner (in the present example, yellow) contained in that developing device is executed (step 10).

Subsequently, the color mode registers 56 are incremented and, if the then data is not "00" data, it is judged that there is other color mode (step 11) and the program proceeds to step 12, and the next developing device is moved to the developing position in accordance with the rotating body movement data of the color mode registers 56 (step 12), whereafter the next single color copy sequence is repeated (step 10). That is, in the present embodiment, subsequently to the yellow developing device 4Y, the magenta developing device 4M is moved to the developing position and the development by magenta toner is effected. Then, the loop of said steps 10, 11 and 12 is repeated until "00" data appears in the color mode registers 56. That is, in the present embodiment, up to the sequence using the cyan developing device 4C and the black developing device 4BK is repeated. Further, if "00" data has been input to the color mode registers 56, the transfer medium is separated from the transfer drum 5*b* by the separating means 8 and is fed out onto the tray 10 via the fixing device 9. On the other hand, the rotating body 400 is moved to the home position in conformity with the "00" data put out from the I/O port 44 to the motor drive circuit 45 (step 13). Thereafter, the program shifts to the key input accept of step 2, at which the ON input of the copy key 50 is waited for.

According to the present invention, as has hitherto been described, the presence or absence of a plurality of developing devices is discriminated and unless all the developing devices are mounted in the rotating body, the image forming operation is not effected and therefore, any biased moment is not applied to the rotating body, and the control circuit of the drive motor can be made compact and simple. Accordingly, a reduced cost can be achieved.

Further, image formation is effected with the kinds of the developing devices discriminated reliably and therefore, even if the developing devices are mounted at any carrying positions in the rotating body, images of good quality can be obtained without being developed in wrong colors.

We claim:

1. An image forming apparatus comprising:

a latent image bearing member;

latent image forming means for forming on said latent image bearing member a latent image corresponding to image information;

developing means for developing the latent image formed on said latent image bearing member, said developing means having a plurality of developing devices and a rotating body for removably carrying said plurality of developing devices thereon;

drive means for rotatively driving said rotating body;

detecting means for detecting whether said plurality of developing devices are carried on said rotating body; and control means adapted to permit an image forming operation only when said detecting means detects that all of said plurality of developing devices are carried on said rotating body.

2. An image forming apparatus according to claim 1, wherein a plurality of said detecting means are provided correspondingly to said plurality of developing devices.

3. An image forming apparatus according to claim 2, wherein said detecting means are provided on said rotating body.

4. An image forming apparatus according to claim 1, wherein said plurality of developing devices contain developers of different colors therein.

5. An image forming apparatus according to claim 4, wherein said plurality of developing devices have inherent discriminating members correspondingly to the colors of the developers contained therein.

6. An image forming apparatus according to claim 5, wherein said detecting means discriminates the individual discriminating members of said plurality of developing devices to thereby detect the kinds of said developing devices when all of said developing devices have been carried on said rotating body, and on the basis of the result of the detection, said control means controls the rotation of said rotating body to correspond to a preset order of image formation and moves the desired developing devices successively to a predetermined developing position.

7. An image forming apparatus according to claim 6, wherein said plurality of developing devices are a developing device having yellow developer, a developing device having magenta developer, a developing device having cyan developer and a developing device having black developer, and said image forming apparatus forms a color image by moving said developing devices to the predetermined developing position in the order of yellow, magenta, cyan and black.

* * * * *